US010148012B2

(12) United States Patent
Wu et al.

(10) Patent No.: US 10,148,012 B2
(45) Date of Patent: Dec. 4, 2018

(54) BASE STATION ANTENNA WITH DUMMY ELEMENTS BETWEEN SUBARRAYS

(71) Applicant: CommScope Technologies LLC, Hickory, NC (US)

(72) Inventors: Bo Wu, Suzhou (CN); Fan Li, Suzhou (CN); Ligang Wu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 232 days.

(21) Appl. No.: 14/976,383

(22) Filed: Dec. 21, 2015

(65) Prior Publication Data

US 2016/0240919 A1 Aug. 18, 2016

Related U.S. Application Data

(60) Provisional application No. 62/116,340, filed on Feb. 13, 2015.

(51) Int. Cl.

| | |
|---|---|
| ***H01Q 1/52*** | (2006.01) |
| ***H01Q 5/49*** | (2015.01) |
| ***H01Q 1/24*** | (2006.01) |
| ***H01Q 21/26*** | (2006.01) |
| ***H01Q 3/44*** | (2006.01) |
| ***H01Q 25/00*** | (2006.01) |

(52) U.S. Cl.

CPC ..... *H01Q 5/49* (2015.01); *H01Q 1/246* (2013.01); *H01Q 1/523* (2013.01); *H01Q 3/44* (2013.01); *H01Q 21/26* (2013.01); *H01Q 25/002* (2013.01)

(58) Field of Classification Search

CPC ..... H01Q 1/521; H01Q 5/21

USPC ..... 343/797, 841

See application file for complete search history.

(56) References Cited

U.S. PATENT DOCUMENTS

| | | | | |
|---|---|---|---|---|
| 6,072,439 | A | 6/2000 | Ippolito et al. | |
| 6,816,124 | B2 * | 11/2004 | Tillery | H01Q 1/246 343/795 |
| 7,535,430 | B2 * | 5/2009 | Le | H01Q 3/16 343/797 |
| 2002/0101388 | A1 * | 8/2002 | Ippolito | H01Q 1/246 343/797 |
| 2002/0135527 | A1 * | 9/2002 | Teillet | H01Q 1/246 343/797 |

(Continued)

FOREIGN PATENT DOCUMENTS

| | | |
|---|---|---|
| WO | 2013190369 | 12/2013 |

OTHER PUBLICATIONS

International Preliminary Report on Patentability and the Written Opinion of the International Searching Authority corresponding to International Patent Application No. PCT/US2016/012665 (10 pages) (dated Aug. 24, 2017).

(Continued)

*Primary Examiner* — Hoang V Nguyen
*Assistant Examiner* — Awat M Salih
(74) *Attorney, Agent, or Firm* — Myers Bigel, P.A.

(57) ABSTRACT

Apparatus include two or more radiating elements connected to a feed network of an antenna, and one or more dummy elements positioned between the two or more radiating elements. The dummy elements are not connected to the feed network of the antenna. Such an arrangement may result in reduced mutual coupling of the two or more radiating elements, and increased antenna performance.

15 Claims, 8 Drawing Sheets

(56) References Cited

U.S. PATENT DOCUMENTS

| | | | | |
|---|---|---|---|---|
| 2002/0140618 | A1* | 10/2002 | Plet | H01Q 1/246 343/797 |
| 2003/0222830 | A1* | 12/2003 | Harel | H01Q 1/246 343/797 |
| 2005/0179610 | A1* | 8/2005 | Le | H01Q 1/246 343/797 |
| 2005/0184921 | A1 | 8/2005 | Roberts et al. | |
| 2005/0253769 | A1* | 11/2005 | Timofeev | H01Q 1/246 343/797 |
| 2007/0008236 | A1* | 1/2007 | Tillery | H01Q 21/30 343/797 |
| 2007/0046558 | A1* | 3/2007 | Tillery | H01Q 1/246 343/797 |
| 2010/0013729 | A1* | 1/2010 | Harel | H01Q 1/246 343/837 |
| 2012/0262351 | A1* | 10/2012 | Hamabe | H01Q 1/241 343/727 |
| 2012/0280878 | A1* | 11/2012 | Timofeev | H01Q 1/246 343/793 |
| 2014/0011460 | A1 | 1/2014 | Ali et al. | |
| 2014/0139387 | A1* | 5/2014 | Jones | H01Q 21/30 343/794 |
| 2014/0368395 | A1 | 12/2014 | Dauguet et al. | |
| 2016/0240933 | A1* | 8/2016 | Wu | H01Q 21/26 |
| 2016/0329642 | A1* | 11/2016 | Chainon | H01Q 19/10 |

OTHER PUBLICATIONS

Extended European Search Report corresponding to European Application No. 16749557.1, dated Aug. 2, 2018, 8 pages.

* cited by examiner frequency

| NAME | | MIN | MAX | MEAN | STDV | TOL |
|---|---|---|---|---|---|---|
| OVERALL | | 62.17 | 94.97 | 79.00 | 10.59 | 15.88 |
| WITHOUT HB DUMMY DIPOLE- | | 65.18 | 94.60 | 79.46 | 10.24 | 15.36 |
| WITHOUT HB DUMMY DIPOLE- | | 62.74 | 94.97 | 79.39 | 11.02 | 16.53 |
| WITHOUT HB DUMMY DIPOLE- | | 62.17 | 92.81 | 78.53 | 10.45 | 15.67 |
| WITHOUT HB DUMMY DIPOLE- | | 62.93 | 93.54 | 78.62 | 10.62 | 15.92 |

| NAME | | MIN | MAX | MEAN | STDV | TYP |
|---|---|---|---|---|---|---|
| OVERALL | | 24.63 | 30.20 | 27.13 | 1.04 | 25.96 |
| WITHOUT HB DUMMY DIPOLE- | —□— | 24.97 | 29.27 | 27.02 | 1.37 | 26.35 |
| WITHOUT HB DUMMY DIPOLE- . | —△— | 24.74 | 30.07 | 27.09 | 1.69 | 25.87 |
| WITHOUT HB DUMMY DIPOLE- | --○-- | 24.63 | 30.20 | 27.11 | 1.76 | 25.78 |
| WITHOUT HB DUMMY DIPOLE- | --◇-- | 24.88 | 30.19 | 27.31 | 1.69 | 26.03 |

| NAME | | MIN | MAX | MEAN | STDV | TOL |
|---|---|---|---|---|---|---|
| OVERALL | | 77.87 | 92.21 | 86.27 | 3.70 | 5.55 |
| WITH HB DUMMY DIPOLE | | 80.87 | 90.26 | 86.17 | 3.16 | 4.75 |
| WITH HB DUMMY DIPOLE | | 80.68 | 90.93 | 86.48 | 3.19 | 4.79 |
| WITH HB DUMMY DIPOLE | | 77.87 | 92.21 | 86.75 | 4.50 | 6.75 |
| WITH HB DUMMY DIPOLE | | 78.09 | 89.82 | 85.82 | 3.69 | 5.54 |

| NAME | | MIN | MAX | MEAN | STDV | TYP |
|---|---|---|---|---|---|---|
| OVERALL | | 25.99 | 29.08 | 27.33 | 0.90 | 26.32 |
| WITH HB DUMMY DIPOLE1 | | 26.32 | 28.58 | 27.38 | 0.88 | 26.41 |
| WITH HB DUMMY DIPOLE1 | | 26.22 | 28.49 | 27.35 | 0.85 | 26.33 |
| WITH HB DUMMY DIPOLE1 | | 25.99 | 28.33 | 27.08 | 0.88 | 26.08 |
| WITH HB DUMMY DIPOLE1 | | 26.31 | 29.08 | 27.50 | 0.85 | 26.42 |

BASE STATION ANTENNA WITH DUMMY ELEMENTS BETWEEN SUBARRAYS

CROSS-REFERENCE TO RELATED APPLICATIONS

This application claims the benefit of U.S. Provisional Patent Application No. 62/116,340 filed on Feb. 13, 2015, the contents of which are incorporated herein by reference in their entirety.

BACKGROUND

Various aspects of the present disclosure may relate to base station antennas, and, more particularly, to dummy elements between subarrays of radiating antenna elements.

Antenna systems are widely used in wireless communication systems to accommodate higher data rates and provide increased capacity. However, it may be difficult to integrate numerous antennas in a small area while keeping a high level of isolation between antenna elements, especially for multi-band antennas. This may be at least partly due to effects of mutual coupling between subarrays of radiating elements. For example, mutual coupling between subarrays of radiating elements become more severe when there is little spatial separation between the radiating elements. Such mutual coupling may significantly affect system performance.

SUMMARY OF THE DISCLOSURE

Various aspects of the present disclosure may be directed to apparatus and methods for reducing mutual coupling between radiating elements. The apparatus may include two or more radiating elements connected to a feed network of an antenna, and one or more dummy elements positioned between the two or more radiating elements. The dummy elements are not connected to the feed network of the antenna.

BRIEF DESCRIPTION OF THE SEVERAL VIEWS OF THE DRAWINGS

The following detailed description of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF VARIOUS EMBODIMENTS

Figure 1:
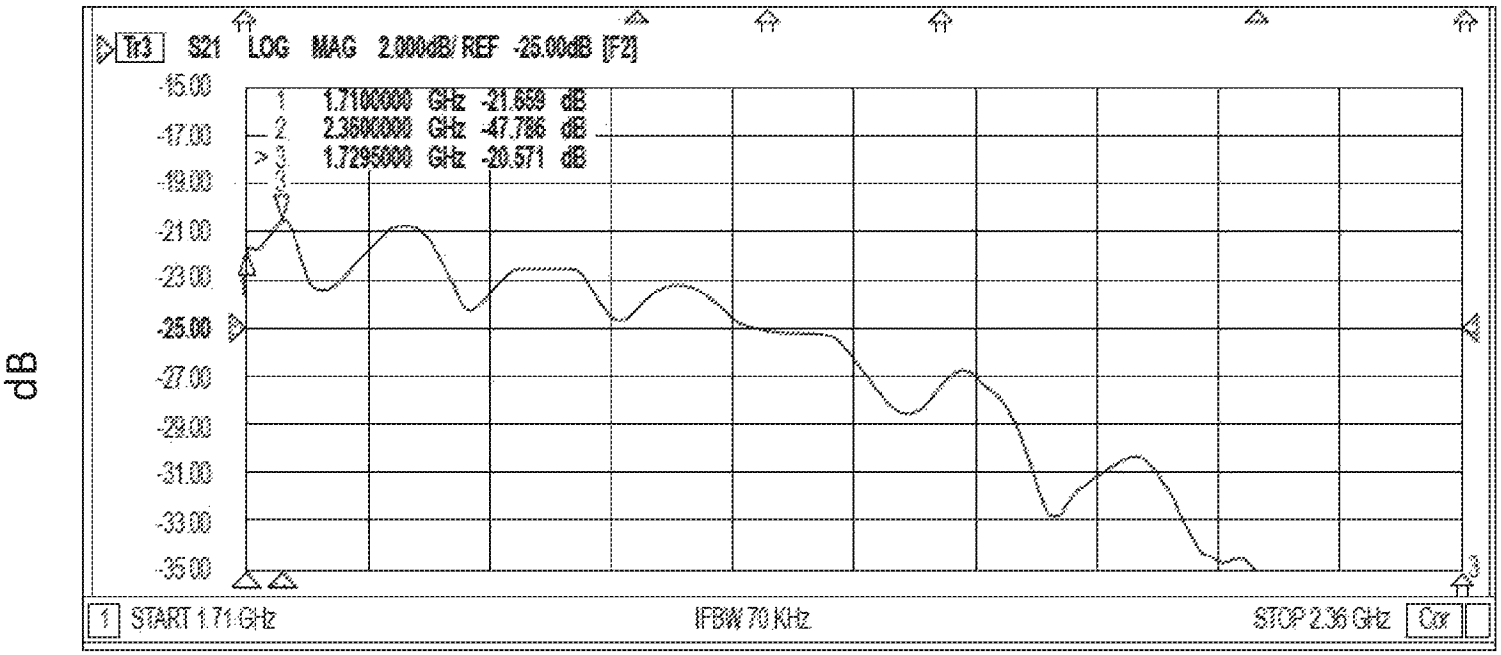
FIG. 1 is an isolation curve of a second band radiating element of a typical base station antenna.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Radiating elements in base station antennas may often times be in close proximately to one another. One problem associated with this close proximity is the interaction of the electromagnetic field of the radiating elements. Such an interaction, otherwise known as mutual coupling, may negatively impact the performance of the base station antenna For example, such close proximity of radiating elements (or subarrays of the same) may result in mutual coupling, which may negatively impact performance of the base station antenna 100, including altering an azimuth beamwidth of the base station antenna, decreasing a front-to-back ratio of a radiation beam pattern of the base station antenna, and/or decreasing an isolation between the radiating elements. Such negative effects are reflected in plotted data shown in FIGS. 1, 2, and 3.

For example, a typical base station antenna may include one or more first band radiating elements (e.g., configured to operate in a first frequency band) and one or more second-band radiating elements, with the first band radiating elements in close proximity to one another. FIG. 1 illustrates an isolation curve of first band radiating elements operating in a particular frequency band of a base station antenna. It may be seen that at an operational frequency (e.g., approximately 1.7 GHz), an isolation value may be approximately 21 dB, which is much less than 30 dB, which, as known in the art, is considered desirable for satisfactory base station antenna operation.

Figure 2:
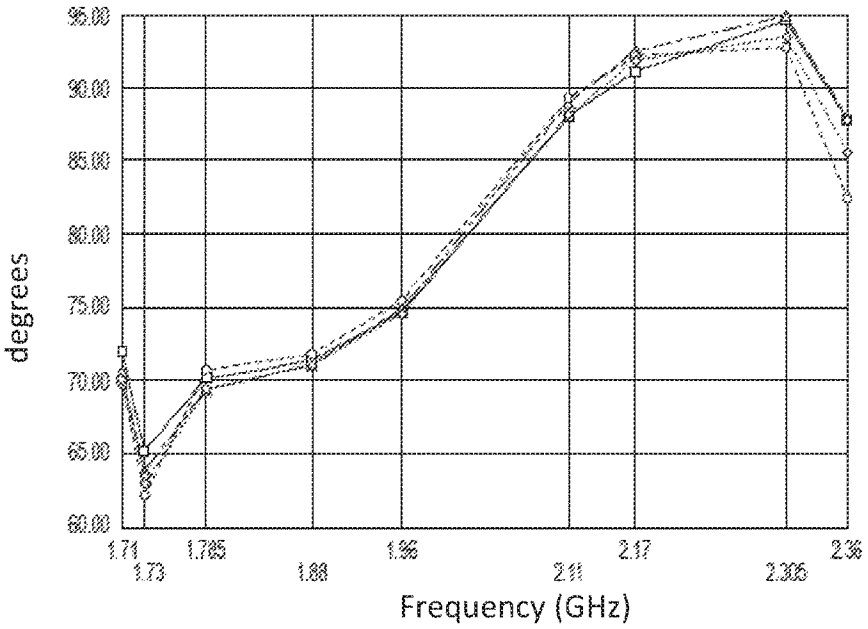
FIG. 2 is a plot showing a 3 dB azimuth beamwidth of various radiating elements vs. frequency of operation of typical base station antenna.

FIG. 2 is a plot showing a 3 dB azimuth beamwidth of various first band radiating elements vs. frequency of operation of the base station antenna. As known in the art, the 3 dB beamwidth may refer to an angular width of a beam where the beam strength is 3 dB below that in the center of the beam. As shown, a majority of the beamwidth values of each of the first band radiating elements, are far from a desirable 85° 3 dB azimuth beamwidth.

Figure 3:
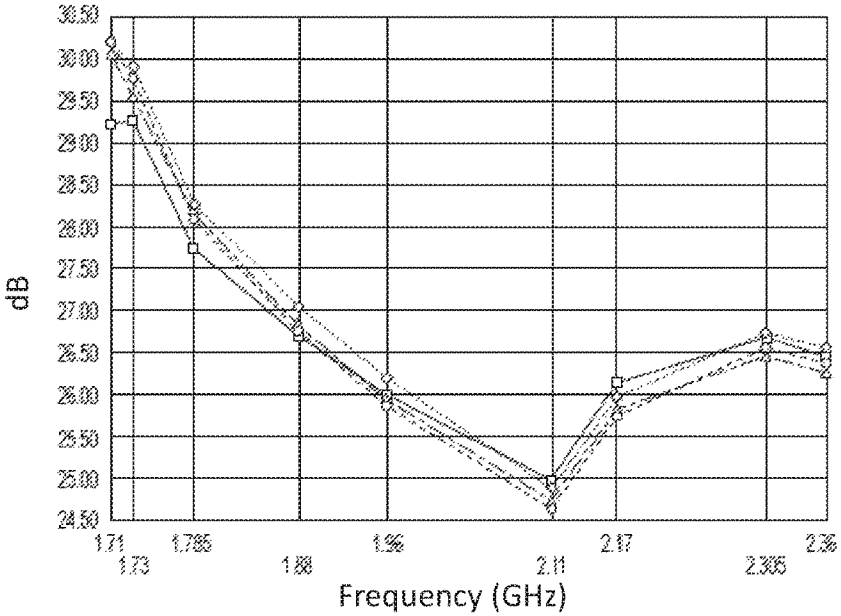
FIG. 3 is a plot showing an azimuth front-to-back ratio of various radiating elements of a typical base station antenna.

FIG. 3 is a plot showing an azimuth front-to-back ratio of various first band radiating elements. This ratio may refer to a ratio of signal strength in front of the base station antenna to signal strength in back of the base station antenna. As shown in FIG. 3, the ratios may be in the range of around 24.75 dB to 26.75 dB at higher operating frequencies.

As discussed above, it may be advantageous for an antenna, such as, for example, a multi-band antenna, to include radiating elements, and/or subarrays of the same, to realize a 3 dB azimuth beamwidth of approximately 85°. To realize this, however, radiating elements (or subarrays of radiating elements) may need to be positioned closer to one another. Unfortunately, mutual coupling generally increases as the distance between radiating elements decreases. To reduce such mutual coupling between closely spaced radiating elements, or radiating element subarrays, aspects of the present disclosure may employ the use of one or more dummy elements positioned between subarrays of radiating elements. As discussed herein, dummy elements may refer to radiating elements that are not actively radiating. For example, the dummy elements may not be connected to a feed network of an antenna.

Figure 4:
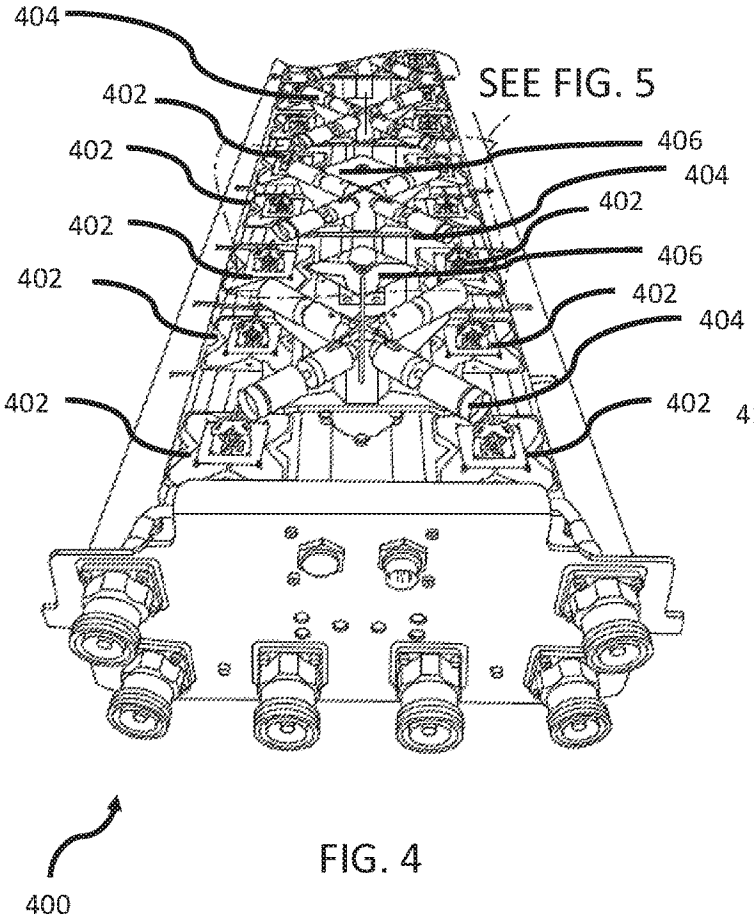
FIG. 4 is a top perspective view of a base station antenna employing dummy elements according to an aspect of the present disclosure.

FIG. 4 is a top perspective view of an example of a base station antenna 400 with a radome removed. The base station antenna 400 may include one or more first band radiating elements 402 configured to operate in a first frequency band (e.g., a high band), and one or more second radiating elements 404 configured to operate in a second frequency band (e.g., a low band). One or more dummy elements 406 may be interspersed among, or positioned between, the first band radiating elements 404. Each of the one or more first and second radiating elements 402, 404 may include a pair of crossed dipole elements. A crossed dipole is a pair of dipoles whose centers are co-located and whose axes are orthogonal. The axes of the dipoles may be arranged such that they are parallel with the polarization sense required. In other words, the axes of each of the crossed dipoles may be positioned at some angle with respect to the vertical axis of the antenna array. For example, the crossed dipoles may be oriented so that the dipole elements are at approximately +45 degrees to vertical and −45 degrees to vertical to provide polarization diversity reception.

Although each of the first and second radiating elements 402, 404 and dummy elements 406 are shown as crossed dipole elements, it should be noted that these radiating elements may be any type of radiating element suitable for use in a wireless communication network configured for personal communication systems (PCS), personal communication networks (PCN), cellular voice communications, specialized mobile radio (SMR) service, enhanced SMR service, wireless local loop and rural telephony, and paging. For example, the individual radiating elements 402, 404, 406 may be also monopole elements, dipole elements, loops, slots, spirals or helices, horns, or microstrip patches.

Figure 5:
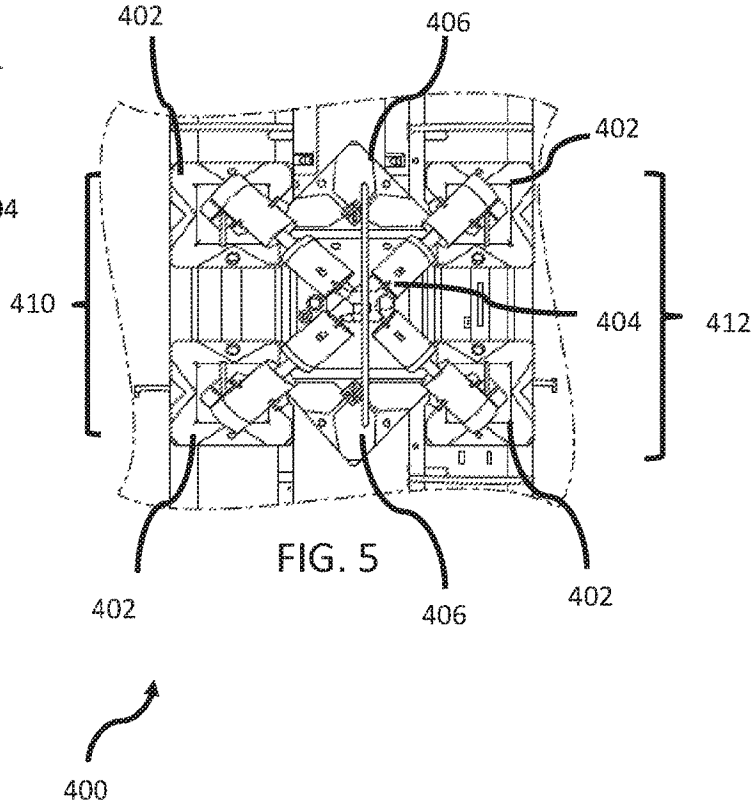
FIG. 5 is an enlarged plan view of a portion of the base station of FIG. 5 according to an aspect of the present disclosure.

FIG. 5 is an enlarged plan view of a portion of the base station antenna 400 showing a spatial arrangement of one of the second-band radiating elements 404 between two subarrays 410, 412 of first band radiating elements 102. The dummy elements 406 may serve to absorb or reflect energy radiated from each of the first-band radiating element subarrays 410, 412, which may be actively radiating (e.g., are connected to a feed network of the antenna 400). The arrangement of these dummy elements 406 (e.g., between the first-band radiating element subarrays 410, 412) may facilitate increased isolation between the first band radiating element subarrays 410, 412. Consequently, increased mutual coupling between subarrays 410, 412 of first-band radiating elements 402 may be significantly reduced, resulting in improved performance of the overall antenna.

Figure 6:
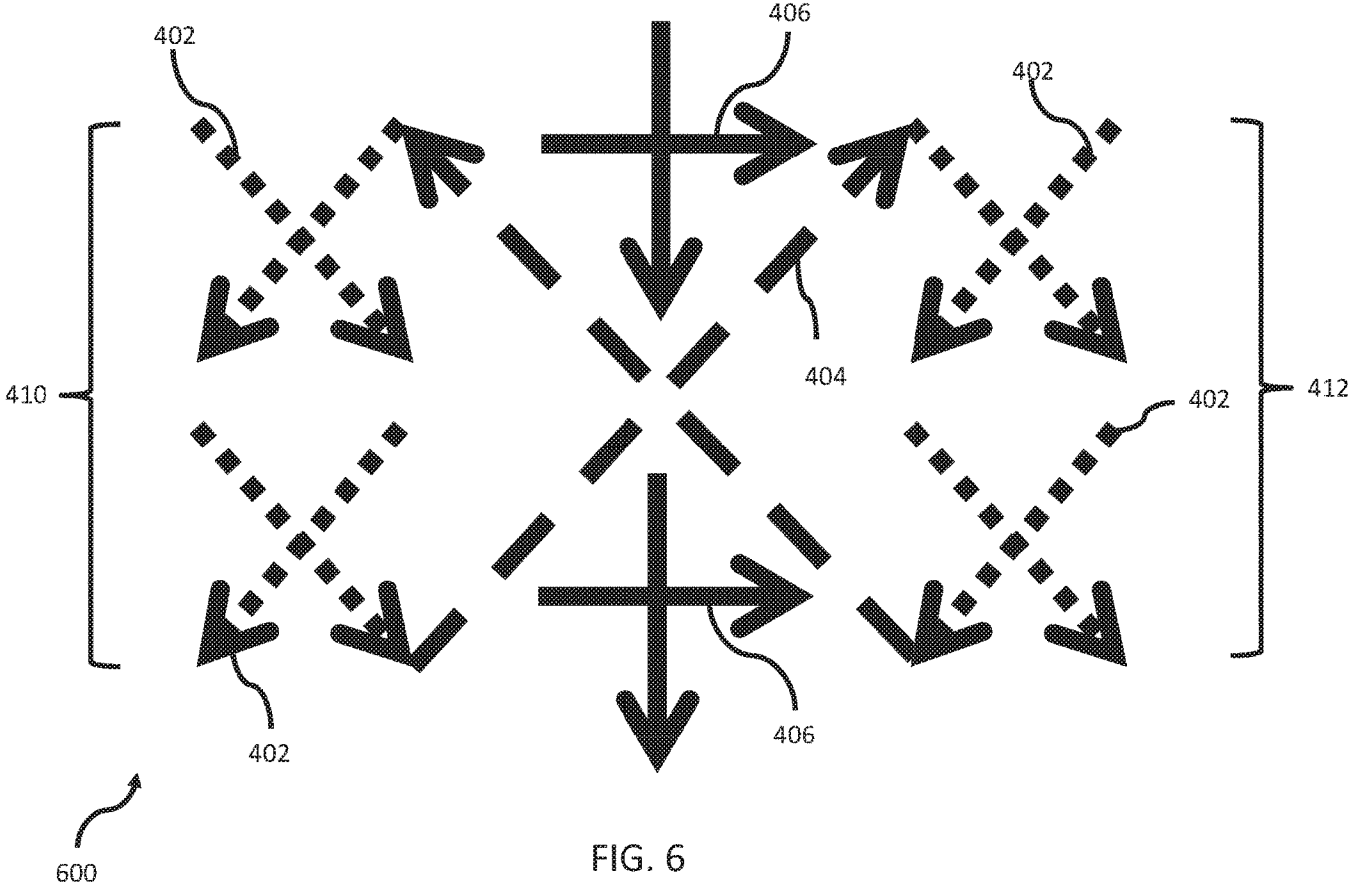
FIG. 6 is a schematic of an antenna arrangement of the base station antenna of FIG. 5.

Referring to FIG. 6, a schematic of a radiating element configuration 600, such as may be incorporated into the base station antenna 400. It should be noted, however, that the radiating element configuration 600 may apply to other types of antennas as well. The radiating element configuration 600 may include one or more second-band radiating elements 404 interspersed between the first-band radiating element subarrays 410, 412. It should be noted, however, that each of the first-band radiating element subarrays 410, 412 may include more or fewer radiating elements in keeping with the disclosure. The first band may refer to a band of frequencies higher than the band of frequencies of the second band. For example, the first-band radiating element 402 may be configured to operate in a range of 1695-2700 MHz, and each of the second-band radiating elements 404 may be configured to operate in a range of 698-960 MHz. Other frequency bands are contemplated in keeping with the spirit of the disclosure. The lateral distance between each of the first-band radiating element subarrays 410, 412 and the dummy elements 406 may be from 0.4λ to 0.8λ of the radiated frequency of the multi-array antenna; however, other distances may be implemented in keeping with the spirit of the disclosure.

According to aspects of the present disclosure, the dummy elements 406 may preferably include dipole arms having a length in the range of 0.3λ-1λ, (where "λ" denotes wavelength) of the active band frequency radiating from the base station antenna, but the length may preferably be 0.5λ. However, the dummy element dipole arms may have lengths in other ranges, as well, in keeping with the spirit of the disclosure. The polarization of each of the dummy elements 406 may also vary. For example, the polarization may be rotated (e.g., via rotation of each of the dipoles of the dummy elements). For example, the polarization may reflect a vertical/horizontal placement as well as a +/−45° slant. However, other polarizations and positions may be used in keeping with the disclosure.

In some cases, it may be advantageous for one or more of the dummy elements 406 to absorb certain amounts of energy, and, in other cases, it may be advantageous for one or more of the dummy elements 406 to reflect certain amounts of energy. Stated differently, one or more of the dummy elements 406 may be resistively loaded or unloaded to control a level of absorption and reflection. For example, to widen a 3 dB beamwidth of the antenna, such as, for example, closer to a desirable 85°, one or more of the dummy elements 406 may be configured to absorb more energy from surrounding subarrays of first-band radiating element subarrays 410, 412, for example, by increasing a resistive load on a foot (e.g., a lower portion of a printed circuit board) of one or more of the dummy elements 406. Alternatively, to lower a 3 dB beamwidth of the antenna, one or more of the dummy elements 406 may be configured to reflect more energy from surrounding subarrays (e.g., of first-band radiating element subarrays 410, 412) by decreasing a resistive load on the foot of the dummy elements 406 or having no resistive load on one or more of the dummy elements 406.

It should be noted that the arrangement 600 described above is by way of non-limiting example only. As such, according to aspects of the present disclosure, the radiating element arrangement may include any number of first-band and/or second-band radiating elements, and any number of dummy elements in keeping with the spirit of the disclosure, Moreover, antennas incorporating radiating element arrangements discussed herein may be configured to operate in more or fewer frequency bands. For example, the radiating element arrangement may include radiating elements and dummy elements comprising any combination of first-band and second-band radiating elements, e.g., with an arrangement comprising one dummy element or dummy element subarray between two active radiating element subarrays.

Figure 7:
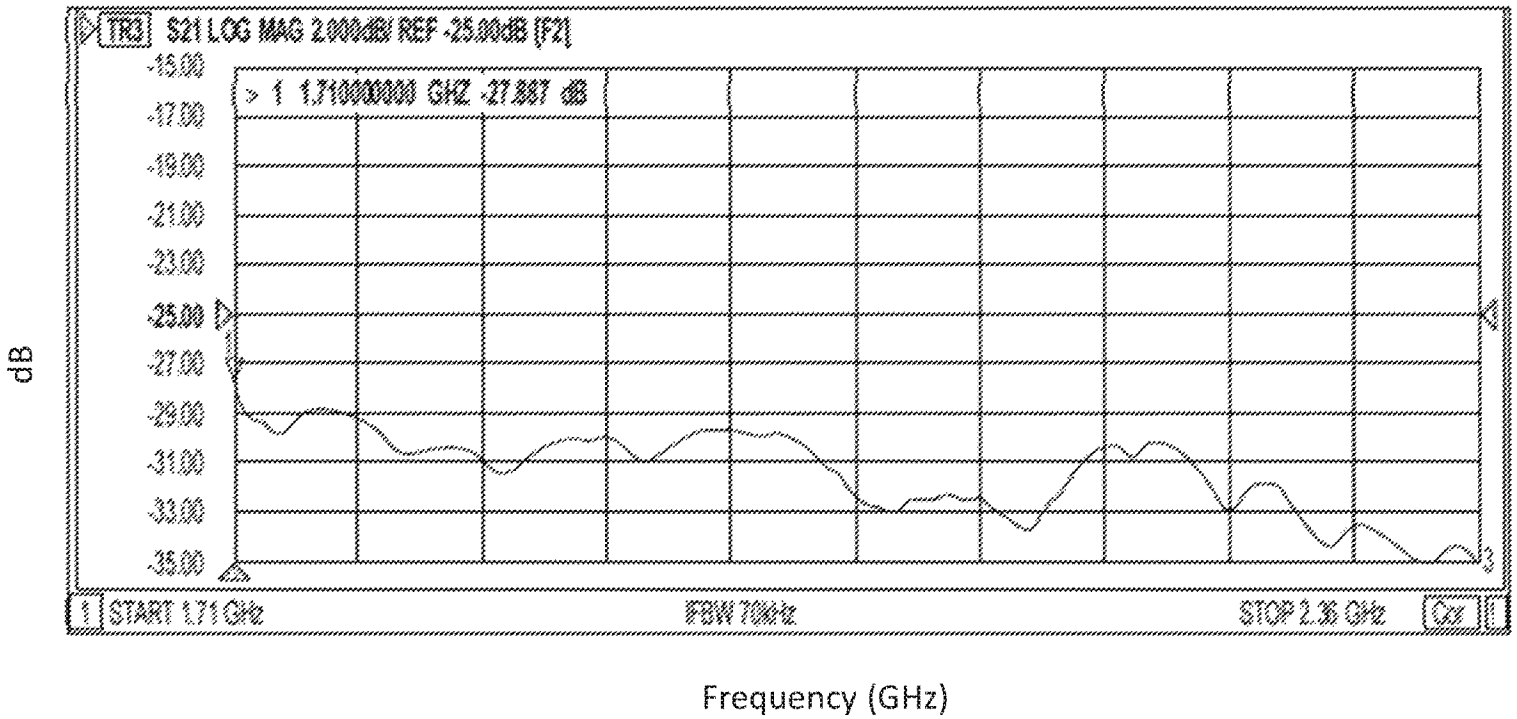
FIG. 7 is an isolation curve of second band radiating elements of an antenna incorporating the antenna arrangement of FIG. 6, according to an aspect of the present disclosure.
Figure 8:
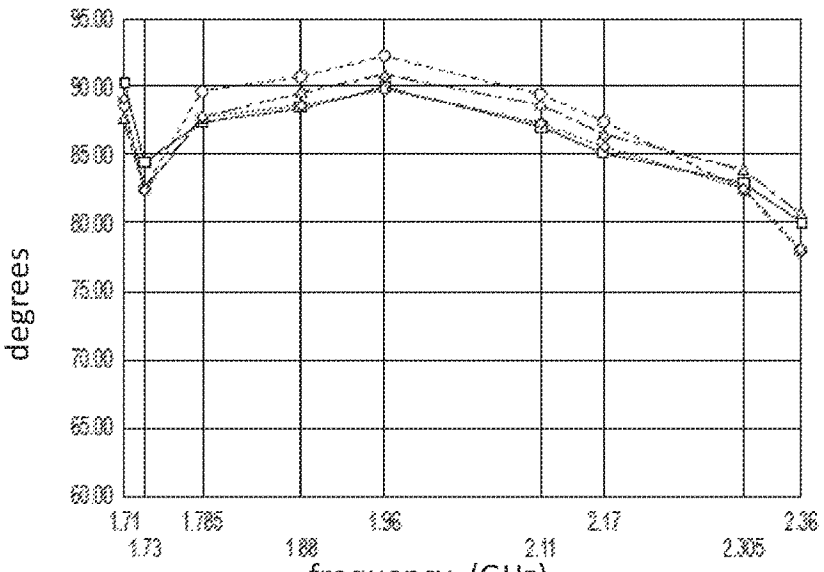
FIG. 8 is a plot showing a 3 dB azimuth beamwidth vs. frequency of operation of various second band radiating elements of an antenna incorporating the antenna arrangement of FIG. 6, according to an aspect of the present disclosure.

Data collected in testing of an example base station antenna incorporating the radiating element arrangement 600 illustrated in FIG. 6 above, will now be discussed with reference to FIGS. 7, 8, and 9. FIG. 7 is an isolation curve between two subarrays, such as the subarrays 410, 412. As can be seen, the isolation value has improved to over 27 dB over the operating frequency around 1.7 GHz FIG. 8 is a plot showing a 3 dB azimuth beamwidth vs. frequency of operation of various first band and second band radiating elements 402, 404. As shown, the 3 dB beamwidth has improved dramatically showing a wide range of frequencies close to or exceeding 85°.

Figure 9:
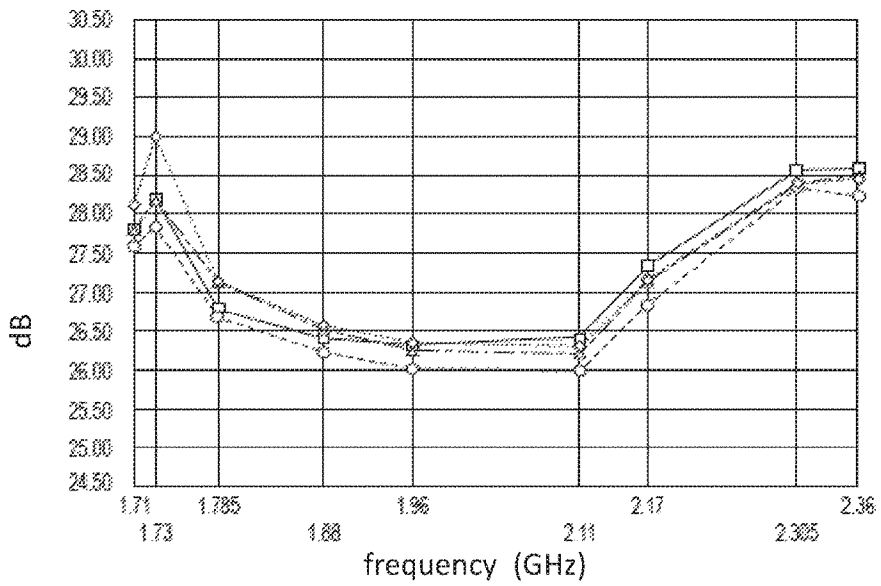
FIG. 9 is a plot showing an azimuth front-to-back ratio vs. frequency of operation of various second band radiating elements of an antenna incorporating the antenna arrangement of FIG. 6, according to an aspect of the present disclosure.

FIG. 9 is a plot showing an azimuth front-to-back ratio employing dummy elements (such as dummy elements 406) according to aspects of the present disclosure. As shown, the azimuth front-to-back ratio has improved over a wide range of frequencies.

As such, discussed hereinthroughout, aspects of the present disclosure may serve to alleviate problems with mutual coupling between active antenna subarrays. Consequently, antennas implementing such designs discussed hereinthroughout may exhibit improved performance.

Various aspects of the present disclosure have now been discussed in detail; however, the invention should not be understood as being limited to these embodiments. It should also be appreciated that various modifications, adaptations, and alternative embodiments may be made within the scope and spirit of the present disclosure.

What is claimed is:

1. An antenna comprising:

two or more first-band radiating elements, configured to operate in a first frequency band and connected to a feed network of the antenna; and one or more dummy elements positioned between two of the two or more first-band radiating elements, wherein the one or more dummy elements are disconnected from the feed network, a third column of second radiating elements, the second radiating elements configured to operate in a second frequency band, wherein the one or more dummy elements includes a dummy element having a printed circuit board, wherein the two or more first-band radiating elements comprise a first column of first-band radiating elements and a second column of first-band radiating elements, and wherein the one or more dummy elements comprise a column of dummy elements that extends between the first column of first-band radiating elements and the second column of first-band radiating elements, and wherein the third column of second radiating elements is between the first column of first radiating elements and the second column of first radiating elements.

2. The antenna of claim 1, wherein at least one of the one or more dummy elements is configured to absorb or reflect energy radiated from at least one of the two or more first-band radiating elements, and wherein the amount of energy absorbed or reflected is based on a load resistance of at least one of the one or more dummy elements.

3. The antenna of claim 1, wherein the first frequency band comprises a band of frequencies higher than the second band.

4. The antenna of claim 3, wherein at least one of the one or more dummy elements includes a dipole having a length in a range of 0.3 wavelength to 1 wavelength of the first or second frequency bands.

5. The antenna of claim 1, wherein each dummy element comprises a cross dipole radiating element that is not actively radiating.

6. The antenna of claim 1, wherein the dummy element that includes the printed circuit board further includes a resistive load on a lower portion of the printed circuit board.

7. A multi-band base station antenna comprising:

a first longitudinally extending column of first radiating elements connected to a feed network of the antenna, the first radiating elements being configured to operate in a first frequency band;

a second longitudinally extending column of first radiating elements;

a third column of second radiating elements, the second radiating elements configured to operate in a second frequency band; and a fourth column of dummy elements positioned transversely between the first column of first radiating elements and the second column of first radiating elements, each dummy element comprising a cross dipole radiating element that is not actively radiating and that is disconnected from the feed network, wherein the third column of second radiating elements is between the first longitudinally extending column of first radiating elements and the second longitudinally extending column of first radiating elements.

8. The antenna of claim 7, wherein the first band comprises a band of frequencies higher or lower than the second band.

9. The antenna of claim 7, wherein each dummy element includes a printed circuit board.

10. The antenna of claim 7, wherein the third column of second radiating elements is collinear with the fourth column of dummy elements.

11. The antenna of claim 7, wherein each dummy element comprises a cross dipole radiating element that includes a horizontally-oriented dipole and a vertically oriented dipole.

12. The antenna of claim 11, wherein each first radiating element comprises a cross dipole radiating element that includes a −45° oriented dipole and a +45° oriented dipole.

13. A method comprising:

connecting two or more first-band radiating elements, configured to operate in a first frequency band to a feed network of an antenna;

positioning one or more dummy elements between two of the two or more first-band radiating elements, the one or more dummy elements being disconnected from the feed network; and selecting an amount of a resistive load of at least one of the one or more dummy elements based on a desired beamwidth for the antenna, wherein the two or more first-band radiating elements comprise a first column of first-band radiating elements and a second column of first-band radiating elements, and wherein the one or more dummy elements comprise a column of dummy elements that extends between the first column of first-band radiating elements and the second column of first-band radiating elements, and wherein a third column of second radiating elements is between the first column of first radiating elements and the second column of first radiating elements.

14. The method of claim 13, wherein the antenna is a base station antenna.

15. The method of claim 13, wherein the resistive load is applied on a lower portion of a printed circuit board of the at least one of the one or more dummy elements.

* * * * *